United States Patent [19]

Mattsson

[11] 4,326,913

[45] Apr. 27, 1982

[54] METHOD AND APPARATUS IN DEFIBRATION

[75] Inventor: Agne T. Mattsson, Enköping, Sweden

[73] Assignee: Aktiebolaget Bahco Ventilation, Enköping, Sweden

[21] Appl. No.: 109,046

[22] Filed: Jan. 2, 1980

[30] Foreign Application Priority Data

Jan. 4, 1979 [SE] Sweden ..... 7900084

[51] Int. Cl.[3] ..... D21C 3/26; D21B 1/04

[52] U.S. Cl. ..... 162/17; 162/21; 162/28; 162/46; 162/47; 162/234; 162/248; 241/28

[58] Field of Search ..... 162/17, 46, 47, 21, 162/234, 248; 241/28

[56] References Cited

U.S. PATENT DOCUMENTS 2,393,783 1/1946 Kridel .
3,184,170 5/1965 Keresztesy .
3,508,713 4/1970 Huppke .
3,627,629 12/1971 Miller ..... 162/234 X
4,061,274 12/1977 Williams .
4,136,831 1/1979 Cederquist et al. ..... 162/47 X
4,163,525 8/1979 Reinhall ..... 162/46 X

FOREIGN PATENT DOCUMENTS 135101 3/1977 Denmark .

*Primary Examiner*—Michael S. Marcus
*Attorney, Agent, or Firm*—Oblon, Fisher, Spivak, McClelland & Maier

[57] ABSTRACT

A method and apparatus in defibration of wood chips or similar vegetable material for conveying in steam pulp produced in a refiner (2) to a separator (7) for separating steam and pulp. The separator is bounded against the atmosphere and is kept pressurized by steam, while a limited amount of excess steam is led off. A flow of steam liberated from the pulp is taken from the separator and given an increased pressure for utilization in extracting pulp from the refiner. The steam flow is hereby led through the refiner and further to the separator, whereby the pulp is transferred to the separator by the steam which thus circulates to a considerable extent, said steam having been given the higher pressure either in the refiner itself, by means of pressure increasing means (19) therein, or upstream of the refiner in a separate pressure increasing means (11).

10 Claims, 5 Drawing Figures

METHOD AND APPARATUS IN DEFIBRATION

A METHOD AND APPARATUS IN DEFIBRATION

The invention relates to a method in defibration of wood chips or similar vegetable material where fibrous pulp from a refiner is transported in steam to a separator adapted for separating pulp from steam. A flow of steam separated from the pulp is taken from the separator and given increased pressure for utilization in removing pulp from the refiner. The separator is kept pressurized by the steam by being kept apart from the atmosphere while a limited amount of excess steam is led off. The invention also relates to apparatus for carrying out the method.

Such a method and apparatus has been described in the Swedish patent application Ser. No. 78 04602-6, in which there is proposed that the steam given the increased pressure is supplied as a driving flow in an ejector used for removing pulp and steam from the refiner.

The object of the present invention is to simplify this method and apparatus, while retaining a pressurized separator.

Some embodiments of the invention are described in detail in the following while referring to the attached drawings.

Figure 1:
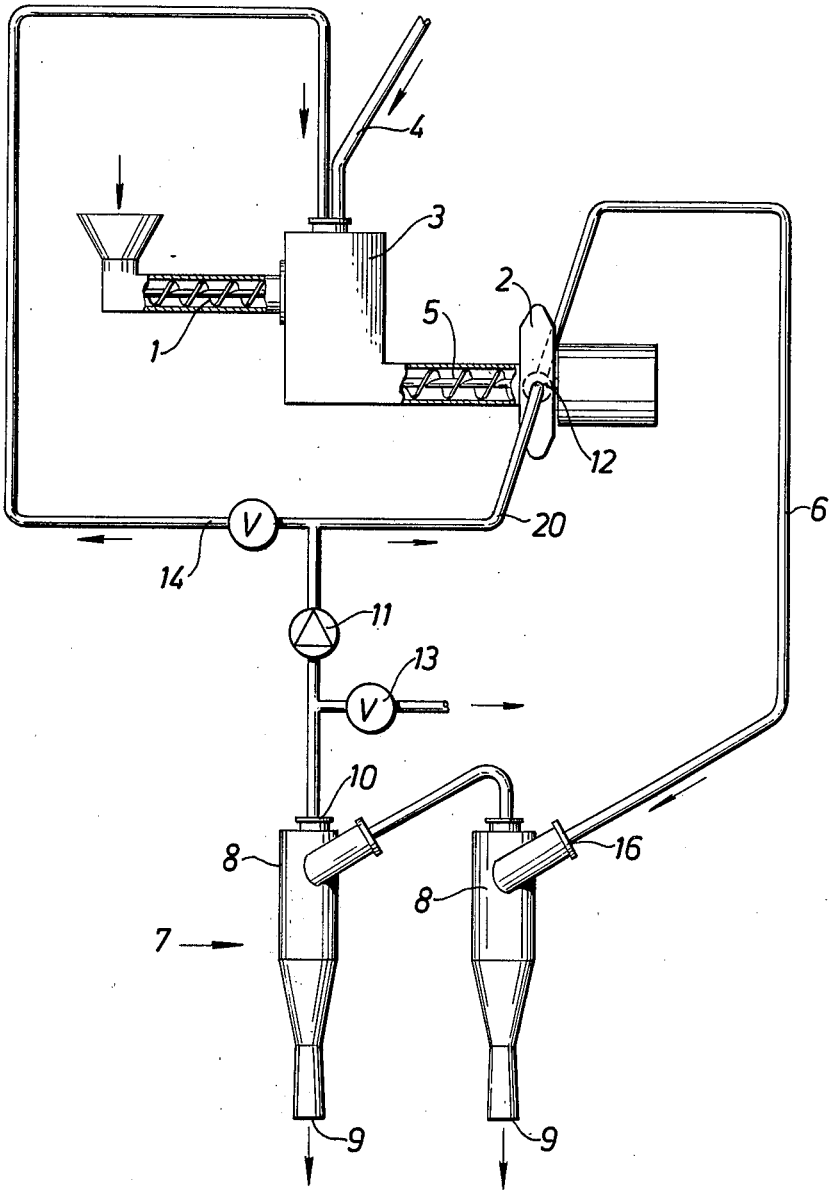
FIG. 1 is a plant diagram clarifying the flow paths for chips and steam in a first embodiment of the invention.

The plant illustrated in FIG. 1 has a screw conveyor feeder 1, which can be assumed to receive raw chips, which may be somewhat preheated. The feeder presses the chips into the preheater 3 of the refiner 2. A supply pipe 4 for fresh steam is connected to the preheater 3 for heating the chips, at least during the starting stage of the defibration process. The chips, now heated to defibration temperature, are fed by a further screw feeder 5 into the refiner 2. The fibrous pulp produced in the refiner is removed together with steam which has been supplied to, as well as generated in the refiner, through a pipe 6 leading to a separator 7, consisting of two cyclones 8 connected in series.

Pulp separated from steam is taken out in a conventional manner by discharge means of a kind such that they close off the cyclone outlet ends 9 pressure tight, so that the cyclones can be pressurized.

Steam liberated from pulp is taken from the gas outlet 10 of the last cyclone 8 and is led via a pipe to the suction side of a fan 11, the pressure side of which is connected via a further pipe 20 to a steam inlet 12 on the refiner. However, grinding energy in the refiner generates an excess of steam from the moisture in the chips, and this steam can be taken out at high pressure and high temperature from the circulation circuit. Accordingly, a steam flow for another purpose is taken out via a pipe 13 upstream of the fan 11, and a further steam flow via a pipe 14 downstream of the fan 11. The latter flow, which thus has been given an increased pressure, is led to the preheater 3. The supply of fresh steam via the pipe 4 can thus usually be reduced after a starting stage.

From what has been described, it will be seen that the steam flow taken from the outlet 10 of the separator 7 is led through the refiner 2 and further back again to the separator, pulp thus being transferred to the separator by means of the steam circulating to a substantial amount through the refiner. By this mode there is eliminated the need of the ejector mentioned in the introduction, and proposed previously in the art for a pressurized separator.

Figure 2:
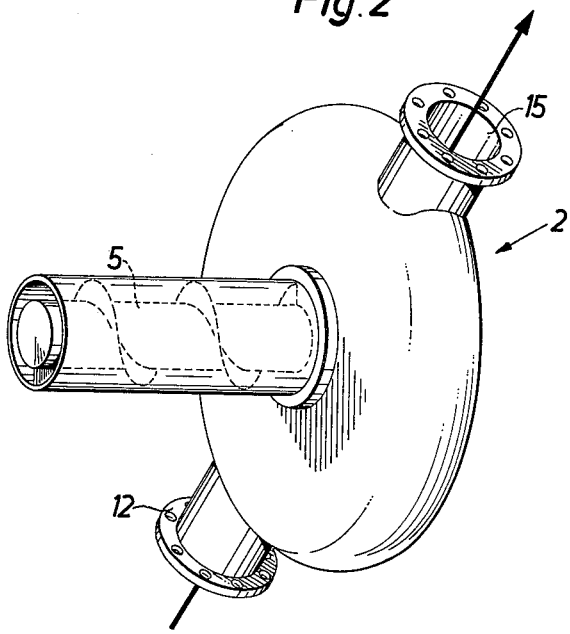
FIG. 2 is a schematic sectional view of the refiner indicated in FIG. 1.

As will be seen better from FIG. 2, the refiner outlet 15 for pulp and steam is situated at a distance from the inlet 12, whereby the steam flows through substantially the entire refiner. The refiner illustrated in FIG. 2 can be of the kind having two outlet openings essentially diametrically opposing each other and affording optional left- or righthand embodiment with regard to the outlet direction, and of which one outlet opening has therefore often been closed off during installation. In the embodiment described above the opening 12, not utilized as outlet, is used instead as inlet for return steam, which conveys pulp produced in the refiner out through the opening 15 and to the inlet 16 of the separator 7 via the pipe 6.

Figure 3:
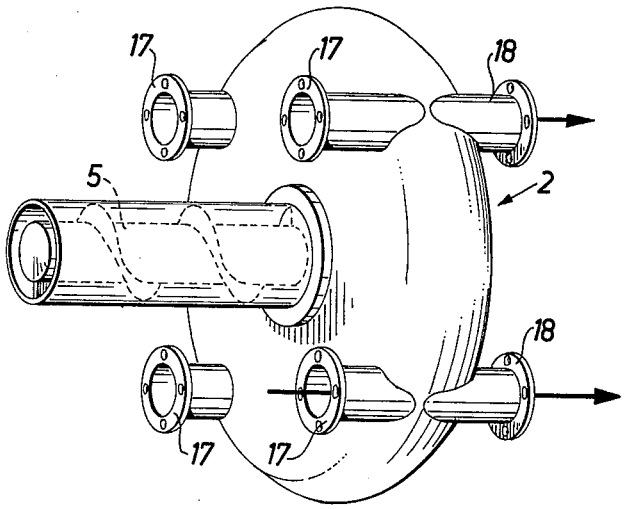
FIG. 3 illustrates an alternative embodiment of the refiner in a corresponding way.

If the refiner is produced especially for applying the method in accordance with the invention, instead of being of a conventional kind, the inlet for return steam and outlet for steam and pulp can be differently arranged, e.g. as is schematically illustrated in FIG. 3. Here, return steam is supplied to the refiner in a direction substantially parallel to the rotational axis of the refiner, steam and pulp also being taken from the refiner in substantially the same direction. The refiner housing has four inlets 17 on one end wall for this purpose, and the same number of similarly distributed outlets 18 (only two are visible in the Figure) on its opposite end wall. These inlets and outlets are formed as pipe stubs, the longitudinal axes of which are parallel to the rotational axis of the refiner. The inlets and outlets are here put together in pairs, each having a common longitudinal axis for its inlet 17 and outlet 18. The steam flows more locally through the refiner in this case.

In the refiners illustrated in FIGS. 1–3, the steam flow taken from the separator 7 is given its increased pressure upstream of the refiner in a separate pressure-increasing means, i.e. the already mentioned fan 11.

Figure 4:
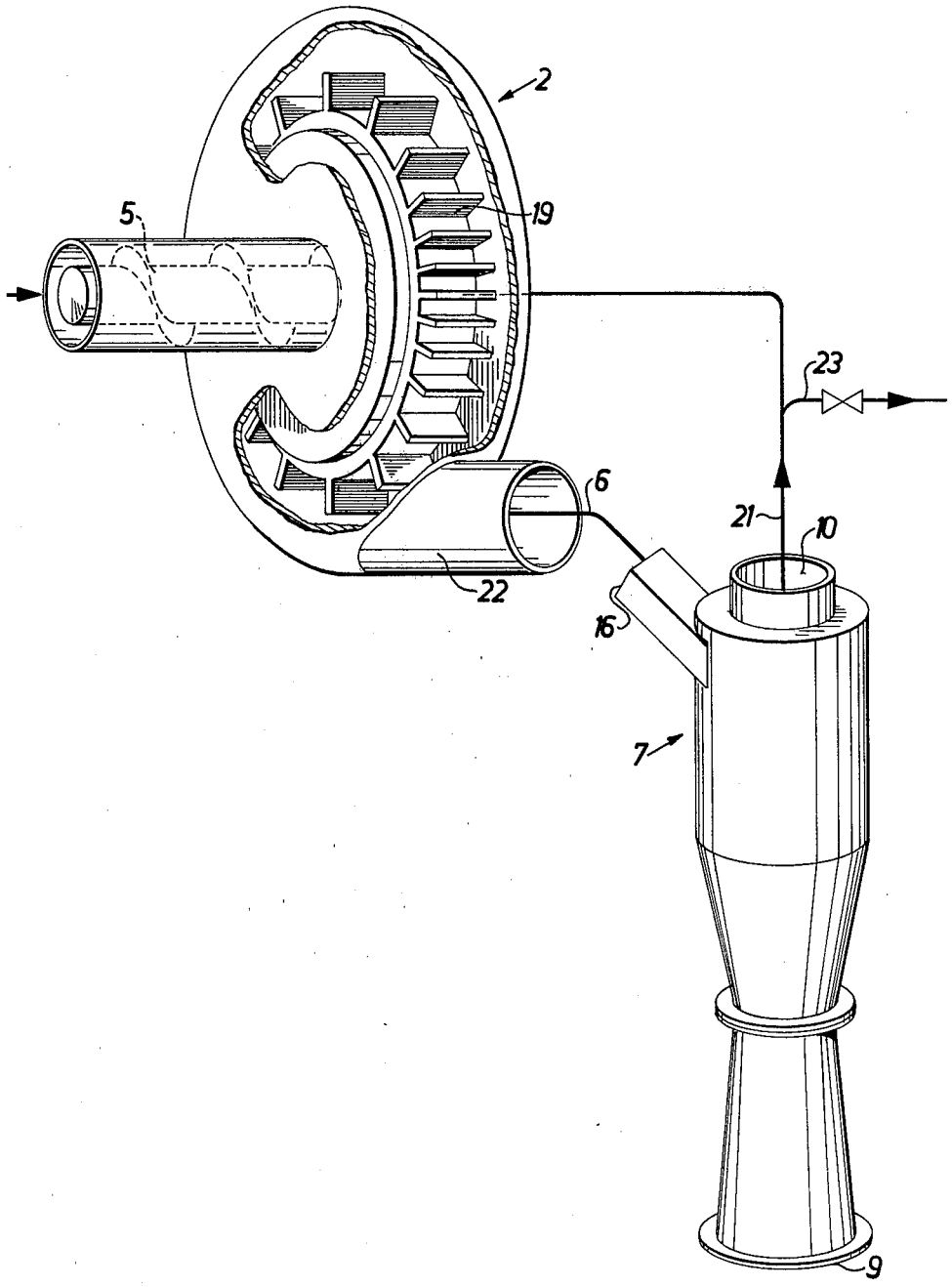
FIG. 4 is a schematic view of a third embodiment of the refiner.

FIG. 4 schematically illustrates another embodiment of a refiner, specially produced for applying the method in accordance with the invention. The steam flow taken from the separator 7 is given the increased pressure in the refiner 2, in this case, the rotor of the refiner being provided with fan blades 19 for this purpose. The steam flow is thus supplied fairly centrally at one end wall of the refiner. The pipe 21 laid from the separator outlet 10 thus opens out at or in the vicinity of the rotational axis of the refiner in the refiner end wall, which is concealed in FIG. 4. The refiner outlet 22 for pulp and steam is arranged tangentially at the circumference of the refiner housing, and connected by means of pipe 6 to the inlet 16 of the separator. Excess steam from the circulation circuit can be taken off via a pipe 23 downstream of the separator, and utilized for some optional purpose.

Figure 5:
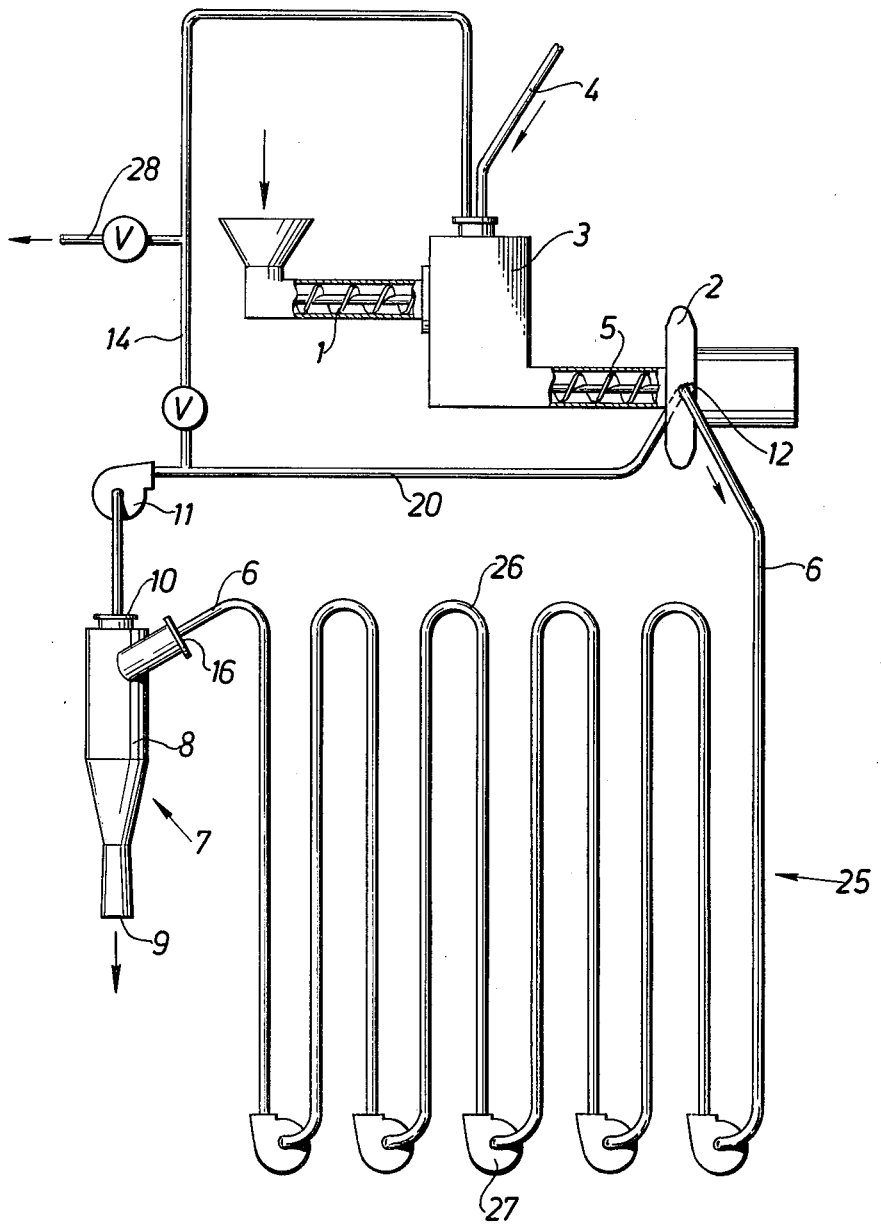
FIG. 5 is a plant diagram illustrating a somewhat modified flow circuit.

FIG. 5 illustrates an example of how the circulation circuit for steam can be modified. Thus, a steam flash drier 25 of a kind known per se can be arranged in the pipe 6 between the refiner 2 and separator 7. Flash drying is carried out in a closed system under pressure. The flash dryer 25 operates with superheated steam supplied via pipes not shown on the drawing. Its coils 26 connected in series afford a long processing distance for the cellulose flakes. The pressure drop in the coils is compensated by conveying fans 27 in the flow path through the coils. The separator 7 receives substantially saturated steam from the flash-dryer, apart from the dried flakes. In this case, when the dryer is part of a pressurized circulation circuit, the dryer does not need any means of its own for pressure-tight supply and discharge of the cellulose flakes, and inter alia does not require any shredder for the pulp, which is otherwise supplied as compressed pulp. By the steam supplied for flash drying being recovered together with remaining excess steam in the circuit, a considerable part of the heat supplied can be utilized. Since the material for drying is supplied directly from the refiner, an undesirable cooling-off of said material is avoided. The installation of the flash dryer 25 in the circulation circuit thus has considerable advantages in contrast to the conventional, separate use of a flash dryer.

The plant according to FIG. 5 concurs for the remainder with what is shown in FIG. 1, apart from differences of a non-essential kind, namely that the separator 7 is only shown as one cyclone and that the saturated excess steam from the circulation circuit is taken out solely via the pipe 14 downstream of the fan 11, said pipe having a branch 28 to a consumption point not shown.

The last-mentioned location of a branch for taking out a steam flow for some purpose requiring increased pressure can naturally also be applied to the plant in FIG. 1, together with, or instead of the discharge via the pipe 13.

The inlet 12 and outlet 15 of the refiner have been shown in FIG. 2 as radially oriented, but can also have some other orientation, although preferably substantially in a plane perpendicular to the rotor axis of the refiner, e.g. a substantially tangential orientation. The number of inlets and outlets can also be varied, and the embodiment illustrated in FIG. 3 can also have inlets and outlets which are mutually displaced. Annular channels in the respective end walls are also conceivable as inlets and/or outlets.

The separator 7 and pressure increasing means 11 can moreover be of any kind at all with the necessary capacity. The means 1, 3 and 5 shown in the flow path of the chips before the refiner can naturally be of some other kind than what has been shown and described.

I claim:

1. An apparatus for defibrating wood chip-like vegetable material, comprising:

a means defining a first source of steam;

a refiner having a housing and including means for reducing wood chip-like vegetable material to pulp;

a first refiner inlet in said refiner housing for introducing vegetable material;

means for transporting said vegetable material to said first refiner inlet;

means connected upstream from said first refiner inlet and further connected to said first source of steam for introducing steam to said wood chip-like vegetable material;

a second refiner inlet in said refiner housing;

a refiner outlet for pulp and steam, said refiner outlet being spaced from said second refiner inlet across an interior volume of said housing;

at least one separator connected to said refiner outlet for separating said steam and pulp, each said at least one separator being adapted to be pressurized by said separated steam and having a steam outlet, said separated steam defining a second source of steam;

conduit means for connecting said second source of steam to said second refiner inlet; and means for increasing the pressure of said separated steam;

whereby said separated steam flows through at least a portion of said refiner and helps transport said pulp from said refiner.

2. Apparatus as claimed in claim 1 wherein said refiner has an axis and two walls of said housing extending transverse to said axis, said refiner including at least one said second inlet on one said wall and at least one said outlet on the second said wall, so that the steam flow can flow through said refiner substantially parallel to said axis.

3. The apparatus of claim 1 wherein said second refiner inlet is located on said refiner housing at a position opposite said refiner outlet.

4. The apparatus of claim 1 wherein said means for increasing the pressure of said separated steam is located in said conduit.

5. The apparatus of claim 1 wherein said means for increasing the pressure of said separated steam is located in said refiner.

6. A method for defibrating wood chip-like vegetable material, comprising the steps of:

introducing steam to wood-chip like vegetable material upstream of a reducing step;

transporting said vegetable material into a refiner;

reducing said vegetable material to pulp in said refiner;

transporting said pulp, together with steam, through an outlet to separator means whereby said separator means is pressurized by said steam;

separating said steam and pulp in said separator means;

removing at least a first portion of said steam from said separator means;

increasing the pressure of said first portion of said steam; and introducing said first portion of said steam directly into said refiner at a location spaced from said outlet across an interior volume of said refiner, whereby said first portion of said steam helps transport said pulp to said separator means, and is itself recycled.

7. The method of claim 6 wherein said step of increasing the pressure of said first portion of said steam occurs in said refiner.

8. The method of claim 6 wherein said step of increasing the pressure of said first portion of said steam occurs before said first portion is introduced into said refiner.

9. Method as claimed in claim 6 or 8 wherein said first portion of said steam is supplied to the refiner in a direction substantially parallel to the rotational axis of said refiner, and that the steam and pulp are taken from the refiner in substantially the same said direction.

10. The method of claims 6 or 8 wherein said first portion of said steam is introduced into said refiner in such a manner that it traverses substantially the entire interior volume of said refiner before being removed therefrom.

* * * * *